United States Patent [19]

Van Patten

[11] 4,434,784

[45] Mar. 6, 1984

[54] VIEWING APPARATUS FOR A CHIMNEY

[76] Inventor: Frederic D. Van Patten, R.D. 1. Stock Rd., Hannibal, N.Y. 13074

[21] Appl. No.: 497,038

[22] Filed: May 23, 1983

[51] Int. Cl.[3] ..... F23J 11/00

[52] U.S. Cl. ..... 126/312; 126/200; 126/307 R; 169/54

[58] Field of Search ..... 110/184, 193; 165/11 R; 431/144, 145; 169/54; 350/438, 439; 126/307 R, 312, 200, 314, 301, 318, 302; 98/46, 45

[56] References Cited

U.S. PATENT DOCUMENTS

| | | | |
|---|---|---|---|
| 746,203 | 12/1903 | Trowbridge | 126/200 |
| 1,135,651 | 4/1915 | Babcock | 126/200 |
| 1,708,987 | 4/1929 | Wager | 356/438 |
| 1,889,483 | 11/1932 | Le Gouz | 169/54 |
| 2,297,808 | 10/1942 | Soucy | 169/54 |
| 2,408,495 | 10/1946 | Wager | 356/439 |
| 2,581,304 | 1/1952 | Sims | 431/13 |

OTHER PUBLICATIONS

Wood Stove Directory, Energy Communications Press, ©1979.

*Primary Examiner*—James C. Yeung
*Assistant Examiner*—Noah Kamen
*Attorney, Agent, or Firm*—Bruns & Jenney

[57] ABSTRACT

Apparatus for viewing the interior of a working chimney so that smoke patterns and the condition of the chimney walls can be continually monitored without the need of discontinuing the operation of a connected stove. The viewing apparatus is rendered airtight so that a fire extinguisher operably connected thereto can fire dry chemicals directly into the chimney in the event a chimney fire is detected.

5 Claims, 3 Drawing Figures

VIEWING APPARATUS FOR A CHIMNEY

BACKGROUND OF THE INVENTION

This invention relates to apparatus for improving the safety of a stove and, in particular, the safety of a wood burning stove that is capable of producing creosote.

Creosote is a highly combustible material that is driven out of wood or wood products during the burning process in the form of a gas. When the burning efficiency of the stove is low, the creosote does not ignite and passes through the flue into the vent chamber of the chimney. As the relatively hot gases pass over the cooler chimney surfaces, the creosote condenses on the chimney walls. After a period of time, the creosote coating will build up to a level that can affect the chimney draw and present a fire hazard. If left unchecked, this highly combustible material will ignite producing extremely intense heat capable of cracking the chimney and spreading to surrounding structures thereby endangering both life and property.

The safest method of preventing chimney fires is to visually inspect the inside of the chimney on a regular basis and clean the chimney when the creosote build-up reaches about one quarter inch in depth. Typically, visual inspection of the chimney heretofore required that the stove be shut down and access be gained to the lower part of the chimney either through the flue opening or an access door. This type of inspection thus oftentimes is not only time consuming but inconvenient as well so that many stove users either ignor the inspection or put it off for dangerously long periods of time.

As will be explained in greater detail below, the apparatus of the present invention provides visual access to the interior of a working chimney while the stove is in operation. Accordingly, the build-up of creosote on the chimney walls can be continually monitored as well as the condition of the smoke passing through the chimney. A great deal about the burning efficiency of the stove can be learnd by observing the color and density of the smoke along with the smoke patterns. This information can be used to determine optimum stove settings which lead to a more efficient and complete burning of the fuel. This decreases the rate at which creosote builds up on the chimney wall, extends the interval between cleanings and considerably reduces the risk of fire.

By monitoring the smoke patterns moving up the chimney, minute openings or cracks in the chimney wall can be quickly identified and repaired before they become a major hazard. The smoke stream line normally moves up the chimney in quiet laminar flow patterns. Any disturbance in this pattern is a clear indication that outside air is being drawn into the chimney through a crack or the like. The flow disturbance manifests itself in the form of small eddys located adjacent to the crack. Accordingly, the break can be accurately pinpointed and repairs quickly carried out before further thermal damage is done to the chimney.

In U.S. Pat. No. 2,355,466 ther is described a flue pipe having a hole formed therein through which the fire pot of a hot water heater is observed. The purpose of the hole is to permit inspection of the burner and the condition of the flame. A door or cover is removably placed over the hole in the pipe in an effort to contain the flue gases and to preserve the airtight integrity of the flue system. The door, however, is not sealed and it is doubtful that this type of observation would be suitable for use in a wood burning environment that gives off relatively dense smoke.

SUMMARY OF THE INVENTION

It is the primary object of this invention to improve the safety of stoves and, in particular, wood burning stoves.

A further object of the present invention is to provide for visual inspection of th interior of a chimney while the chimney is working.

A still further object of the present invention is to provide early indications of the formation of cracks and openings in a chimney so that repairs can be made before serious harm is done to the chimney structure.

Another object of the present invention is to enable a wood stove user to more efficiently set the controls of a wood burning stove and thus reduce the creosote build-up rate on the chimney walls.

Yet another object of the present invention is to allow for the continual visual monitoring of creosote build-up on the interior walls of a chimney so that cleaning of the chimney can be accomplished before a fire ensues.

A still further object of the present invention is to eliminate the need to shut down a stove in order to visually inspect the chimney to which the stove is connected thereby minimizing unwanted down time.

These and other objects of the present invention are attained by means of apparatus that includes an airtight thimble passing into the vent chamber of a chimney directly below the flue entry of a stove. An angularly disposed bracket supports a mirror in the chimney opposite the thimble opening to permit the interior of the chimney to be viewed through the thimble. An airtight observation door covers the outside end face of the thimble and contains a transparent window for viewing the mirror. A dry chemical fire extinguisher is connected into the thimble that can be activated in the event of a chimney fire. The chemicals are pulled by natural draft into the fire region without having to open the stove thus avoiding a potentially dangerous situation.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
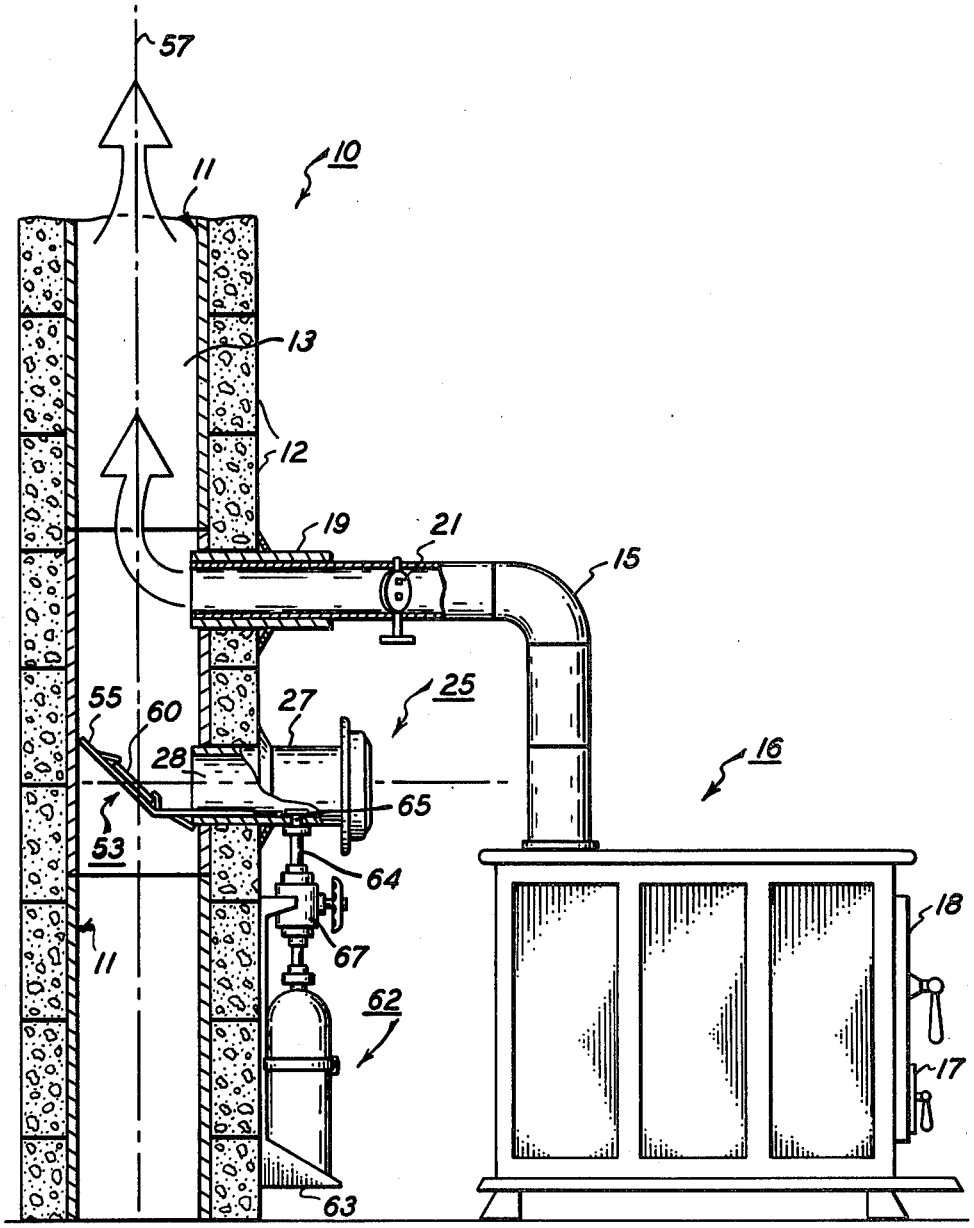
FIG. 1 is a side elevation in partial section illustrating the apparatus of the present invention mounted in a chimney used to service a wood burning stove.

Referring now to the drawings and, in particular, to FIG. 1 there is shown a chimney, generally referenced 10, that includes hollow interior tiles 11—11 which are encased within cement blocks 12—12 to form a vertically disposed vent chamber 13. The lower part of the chimney is connected via a flue pipe 15 to a conventional wood burning stove 16. The stove, as herein depicted, is an airtight unit having at least one inlet air control vent 17 mounted in the door 18 of the unit that can be adjusted to control the amount of ambient air supplied to the combustion chamber of the stove. The flue pipe 15 is connected into the back of the stove and is telescoped into a first upper draft thimble 19 that passes through the chimney wall into the vent chamber 13. The thimble 19 is mortared into the chimney to provide an airtight permanent joint therebetween. Although not shown, fireproof packing is placed between the flue pipe and the thimble to furnish a second airtight joint between the telescoped surfaces whereby the draft generated in the chimney is felt in the combustion chamber of the stove.

An adjustable damper 21 is placed in the flue pipe 15 which is used to control the flow of flue gases into the chimney. As is well known in the art, the air inlet vent and the damper can both be regulated to control the burning process to attain the most efficient combustion. The factors affecting combustion can vary from day to day or even hour to hour so that the damper and/or air vent setting generally must be periodically readjusted to meet changing conditions. As previously pointed out, the condition of the smoke passing through the chimney is an accurate means of judging when the optimum settings have been attained.

An observation station, generally depicted at 25, is located immediately below the stove flue entrance to the chimney. The observation station permits visual inspection of the chimney while the stove is working. The observation station is a completely sealed unit which will not adversely affect the chimney draft and thus the operation of the stove. The unit includes a second observation thimble 27 passing through one side wall of the chimney immediately below the first draft thimble 19. The observation thimble is sealed into the chimney using any bonding agent suitable for forming an airtight heat sensitive joint. The interior opening 28 in the thimble opens directly into the vent chamber of the chimney and provides visual access to the chimney.

Figure 2:
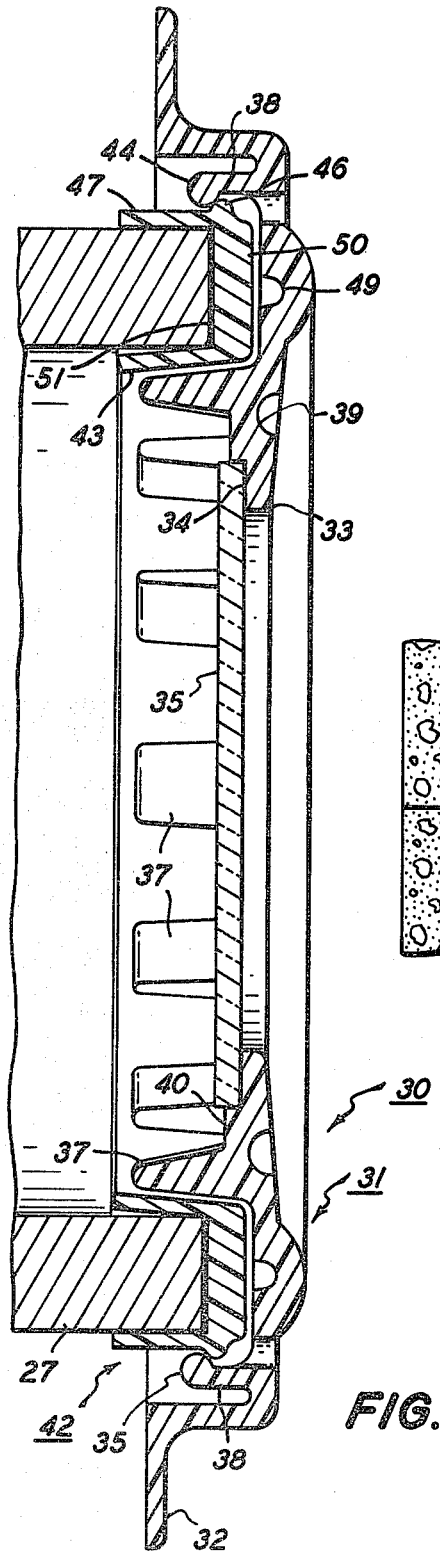
FIG. 2 is an enlarged side elevation in section showing the observation door used to seal the outer end of a thimble passing into the chimney.

Turning now to FIG. 2, a removable observation door 30 is fitted over the outside end face of thimble 27. The door is formed of a single piece of circular heat resistant plastic that is molded in a single operation to the shape illustrated. The door contains an annular hub 31 and a radially extended flange 32. A central opening 33 is formed in the hub having a recessed shoulder 34 in which is secured, as for example by gluing, a transparent glass window 35. A circular flange 37 is disposed inwardly from the back face of the hub and is arranged to engage in sliding contact the inner side wall 43 of a U-shaped boot that is seated over the outside end face of thimble 27. In operation, the circular flange compresses the wall 43 against the inside surface of the thimble to establish an airtight joint therbetween. An outer groove 39 is formed in the door which provides sufficient flexibility to the flange to maintain contact with the boot about the entire periphery of the wall 43.

A series of snap connectors 38—38 also depend from the back face 40 of the door hub. The connectors are axially disposed in reference to the thimble and each connector terminates in a ball 44. In assembly, the ball in each connector is adapted to snap over an annular raised projection 46 extending about the outer wall 47 of the boot. The snap connectors are provided with sufficient flexibility to permit the balls to lock the door securely to the boot once the balls have passed over the boot protrusion 46.

The boot is also molded by any suitable process into a channel-like configuration having a circular opening that compliments the end section of the thimble. The boot includes the previously noted walls 43 and 47 and an annular base 50. The inside face 51 of the base, which seats against the end face of the thimble in assembly, is roughened or texured to provide small pockets in which a suitable adhesive for bonding the boot to the thimble can be housed. In practice, the adhesive is coated on the surface 51 and the end face of the thible and the boot is seated securely over the thimble end face. Upon setting, the adhesive holds the boot tightly to the thimble so that the boot will not pull away when the door is opened or closed.

Figure 3:
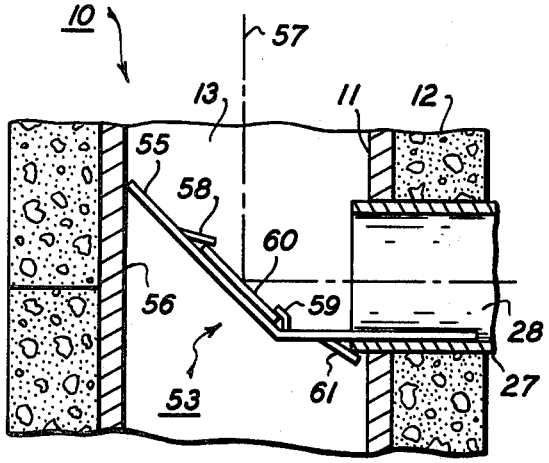
FIG. 3 is a partial side view of the chimney at the thimble opening showing a bracket used to support a mirror inside the vent chamber of the chimney.

Turning now to FIG. 3, an angular shaped bracket 53 is situated in the vent chamber 13 of the chimney at the observation thimble opening. The bracket includes a horizontal base 54 seated in the thimble opening and an inclined support wall 55 that rests against the rear surface 56 of the vent chamber to form a 45° angle with the vertical centerline 57 of the chimney. A pair of dependent clips 58 and 59 are punched out of the bracket and serve to affix a mirror 60 upon the inclined wall 55. A locating lug 61 is also punched downwardly from the base of the bracket which contacts the front surface of the vent chamber at the thimble opening to locate the bracket within the chimney. When the bracket is properly located in the chimney, the entire vertical length of the vent chamber can be clearly viewed through the window in the observation door.

A dry chemical fire extinguisher 62 (FIG. 1) is supported below the observation thimble 27 by means of a wall mounted sling 63. The nozzle 64 of the extinguisher bottle is joined to a connector 65 that passes through the thimble wall. The connector is sealed in assembly to preserve the airtight integrity of the thimble. Accordingly, the bottle can be activatied to discharge dry chemicals directly into the thimble opening in the event a chimney fire is detected. Because the thimble is sealed against leakage, the dry chemical is pulled rapidly into the chimney and brought directly to the fire region where it can combat the blaze. The extinguisher can be fired manually through means of a valve 67 when a potentially dangerous situation is observed or it alternatively can be fired automatically by either a pressure sensitive or thermal sensitive switch when the stove is left unattended.

The apparatus of the present invention thus is able to improve the safety of a wood burning stove in two ways. First, it provides the user with an accurate means for visually monitoring the inside of a working chimney without having to disconnect the stove. When dangerous levels of creosote are observed, the chimney can be cleaned and put back in service before the creosote has a chance to ignite. Secondly, by being able to monitor the condition of the smoke in the chimney, the user can further adjust the stove controls with greater accuracy to attain more efficient burning of the fuel. This, in turn, reduces the rate at which creosote builds up on the chimney again reducing the risk of fire and allowing for longer periods between chimney cleaning.

The apparatus of the present invention further provides an extremely safe means for introducing chemicals into the chimney for combating fires. As explained above, the chemicals can be fired into the airtight thimble and from the thimble be carried quickly to the blaze without having to open the stove.

While this invention has been described with reference to the structure disclosed herein, it is not confined to the details set forth and this application is intended to cover any modifications or changes as may come within the scope of the following claims.

I claim:

1. Apparatus for visually monitoring the vent chamber of a chimney while the chimney is drawing exhaust gases through the flue of a stove that includes a hollow member sealed in one wall of the chimney below the flue entrance of the stove, said hollow member having an inside end face passing into the vent chamber of the chimney and an outer end face protruding beyond said one wall of the chimney, a bracket means angularly disposed within the vent chamber adjacent to the inside end face of said hollow member, a mirror means supported upon the said bracket within the vent chamber to permit the chamber to be viewed through the hollow member, an observation door having a transparent window therein, said door being removably mounted over said outside end face of said hollow member, and sealing means acting between said door and said hollow member to provide an airtight joint therebetween when the door is in a closed position whereby said hollow member provides an airtight passage communicating with the vent chamber.

2. The apparatus of claim 1 that further includes a flexible boot that passes over the outside end face of the hollow member and connecting means for securing the door to the boot when the door is placed in a closed position.

3. The apparatus of claim 2 wherein said door further includes an axially disposed flange that is slidably received within the boot to bias the boot against the inner wall of the hollow member when the door is in a locked position thereby sealing the boot against the inner wall of the hollow member.

4. The apparatus of claim 1 wherein said bracket means further includes a base seated in the hollow member and a locating lug for engaging a wall of said chimney to position the bracket in the vent chamber.

5. The apparatus of claim 1 that further includes a fire extinguisher connected into the hollow member for discharging fire extinguishing chemicals into the airtight hollow member whereby chemicals introduced into the hollow member are drawn rapidly into the chimney.

* * * * *